US008375861B2

(12) United States Patent
Dale et al.

(10) Patent No.: US 8,375,861 B2
(45) Date of Patent: Feb. 19, 2013

(54) PROJECTILE THAT INCLUDES A GIMBAL STOP

(75) Inventors: Erik T. Dale, Tucson, AZ (US); Ryan A. Egbert, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 160 days.

(21) Appl. No.: 12/844,493

(22) Filed: Jul. 27, 2010

(65) Prior Publication Data

US 2012/0024185 A1 Feb. 2, 2012

(51) Int. Cl.
*F42B 10/00* (2006.01)

(52) U.S. Cl. ..... 102/517; 102/501

(58) Field of Classification Search ..... 102/347, 102/374, 378, 379, 501, 517
See application file for complete search history.

(56) References Cited

U.S. PATENT DOCUMENTS

| | | | | | |
|---|---|---|---|---|---|
| 4,238,802 | A | * | 12/1980 | Speicher | 343/765 |
| 4,240,596 | A | * | 12/1980 | Winderman et al. | 244/3.16 |
| 4,282,529 | A | * | 8/1981 | Speicher | 343/765 |
| 4,304,381 | A | * | 12/1981 | Lloyd | 248/179.1 |
| 4,392,140 | A | * | 7/1983 | Bastian et al. | 343/765 |
| 4,396,919 | A | * | 8/1983 | Speicher | 343/765 |
| 4,490,724 | A | * | 12/1984 | Bickman | 343/765 |
| 4,619,421 | A | * | 10/1986 | Trummer | 244/3.16 |
| 5,143,334 | A | * | 9/1992 | Sardou et al. | 248/184.1 |
| 5,279,479 | A | * | 1/1994 | Adama et al. | 244/3.16 |
| 5,791,591 | A | * | 8/1998 | Hoban | 244/3.16 |
| 6,036,140 | A | * | 3/2000 | Tranapp et al. | 244/3.16 |
| 6,386,886 | B1 | * | 5/2002 | Filaretos | 439/21 |
| 7,264,220 | B2 | * | 9/2007 | Dent et al. | 248/660 |
| 7,471,451 | B2 | * | 12/2008 | Dent et al. | 359/421 |
| 7,561,784 | B2 | * | 7/2009 | Wescott et al. | 396/13 |
| 7,671,311 | B2 | * | 3/2010 | Ellison et al. | 244/3.1 |
| 7,862,188 | B2 | * | 1/2011 | Luty et al. | 359/861 |
| 2006/0071121 | A1 | | 4/2006 | Wescott et al. | |
| 2010/0043577 | A1 | * | 2/2010 | Rosheim | 74/5.4 |

FOREIGN PATENT DOCUMENTS

WO WO-2012044341 4/2012

OTHER PUBLICATIONS

"International Application Serial No. PCT/US2011/00962, International Search Report mailed Mar. 20, 2012", 2 pgs.
"International Application Serial No. PCT/US2011/00962, Written Opinion mailed Mar. 20, 2012", 5 pgs.

* cited by examiner

*Primary Examiner* — Michael David
(74) *Attorney, Agent, or Firm* — Schwegman Lundberg & Woessner, P.A.

(57) ABSTRACT

Some embodiments pertain to a projectile that includes a frame and a first gimbal that is rotatably supported by the frame. The projectile further includes a second gimbal that is rotatably supported by the first gimbal. A sensor is supported by the second gimbal such that an adjustment mechanism is able to maneuver the first and second gimbals to adjust the position of the sensor. The projectile further includes a stop that is attached to the frame. The stop may be a cup that surrounds a bottom portion of the sensor. The cup provides a barrier to prevent the adjustment mechanism from maneuvering the sensor outside a designated area.

10 Claims, 6 Drawing Sheets

PROJECTILE THAT INCLUDES A GIMBAL STOP

GOVERNMENT RIGHTS

This invention was made with government support under Contract Number FA8213-09-D-0008 awarded by the Department of the Air Force. The government has certain rights in the invention.

TECHNICAL FIELD

Embodiments pertain to a projectile that includes a sensor, and more particularly to a projectile that includes a movable sensor.

BACKGROUND

Projectiles that include sensors typically have the sensors mounted on a pair of gimbals. The two gimbals usually rotate on axes that are perpendicular to one another to allow two degrees of freedom of sensor movement relative to a frame of the projectile. Each degree of freedom is controlled by a force acting at a distance from the axis of rotation of each respective gimbal. The force is sometimes applied by a pushrod that is attached to a drive mounted to the frame of the projectile below the gimbals. The gimbals are maneuvered by adjusting the pushrods.

Historically, a stop was located near the gimbals to limit movement of the sensors and/or gimbals when the projectile experienced a loss of power or a rapid acceleration. Limiting the movement of sensors/gimbals under these circumstances can help prevent damage to the adjustment mechanism and/or sensor.

The use of pushrods to maneuver the gimbals is one example type of design within some projectiles that include maneuverable sensors. One of the drawbacks with the use of pushrods is that it is difficult to position the stop in a location that does not interfere with the operation of the pushrods.

DETAILED DESCRIPTION

The following description and the drawings sufficiently illustrate specific embodiments to enable those skilled in the art to practice them. Other embodiments may incorporate structural, logical, electrical, process, and other changes. Portions and features of some embodiments may be included in, or substituted for, those of other embodiments. Embodiments set forth in the claims encompass all available equivalents of those claims.

As used herein, projectile refers to missiles, guided projectiles, unguided projectiles, gliders, manned and unmanned air vehicles and sub-munitions.

Figure 1:
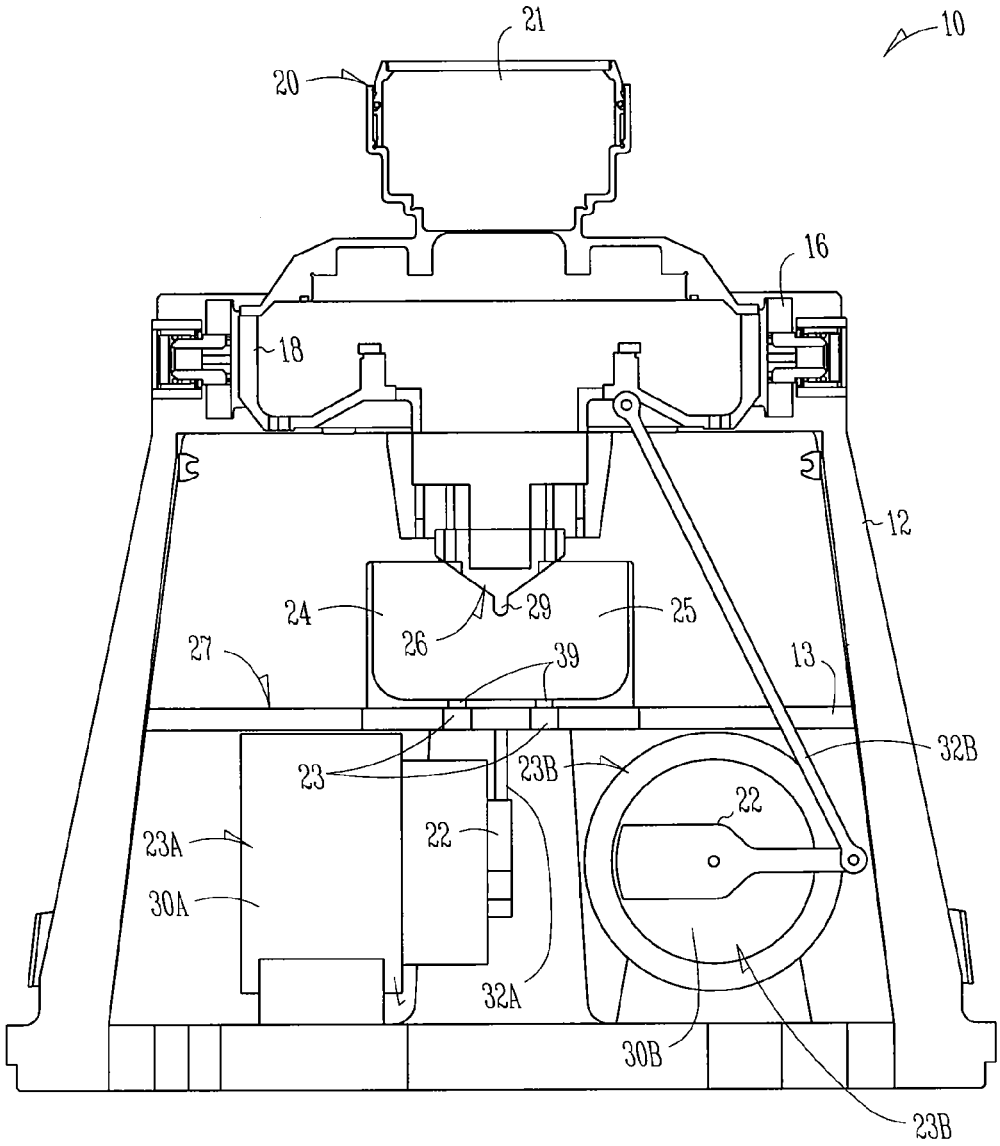
FIG. 1 is a schematic section view illustrating a portion of an example projectile where a sensor within the projectile does not engage a stop.
Figure 2:
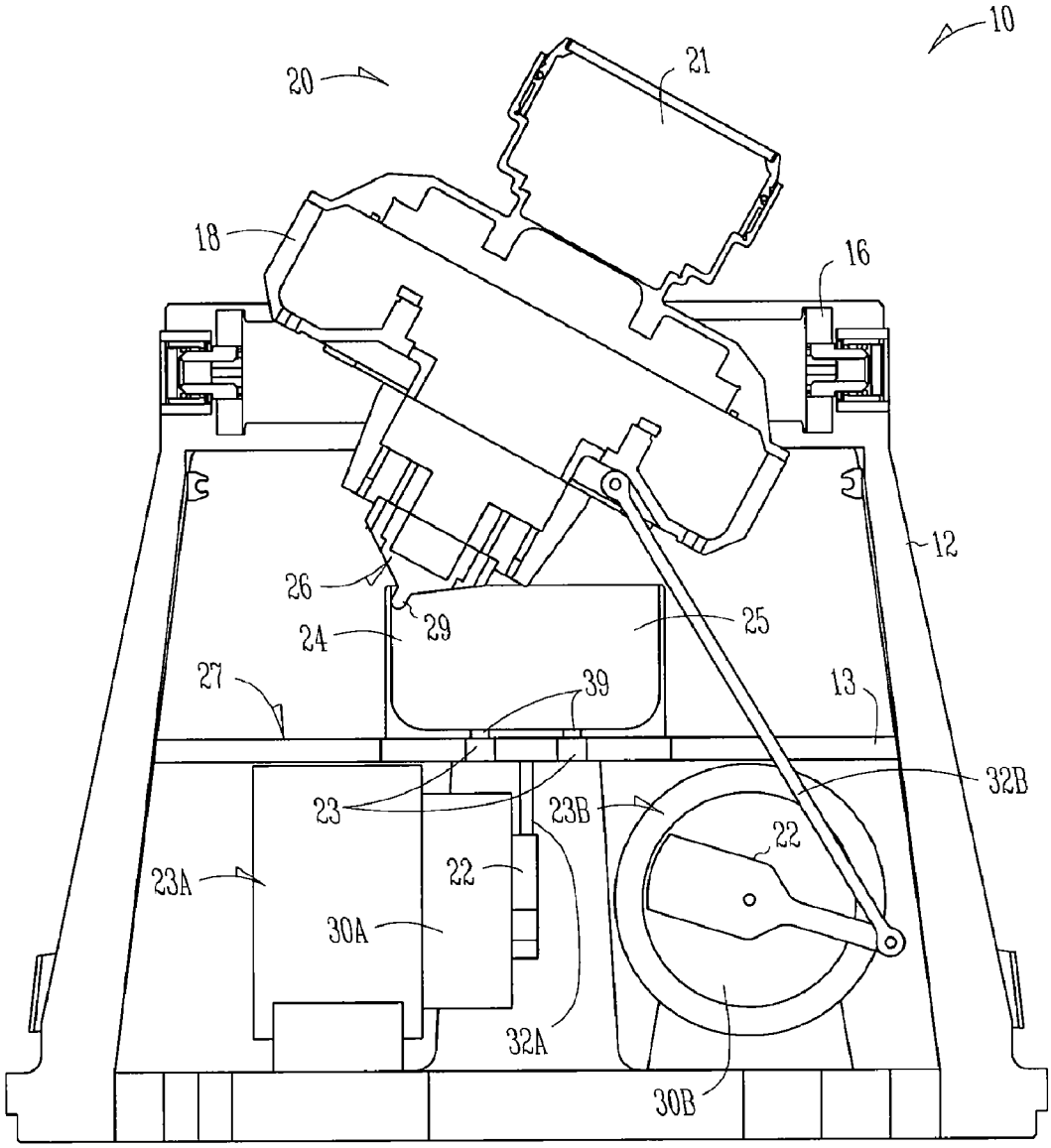
FIG. 2 is a schematic section view illustrating the portion of the projectile shown in FIG. 1 where the sensor within the projectile is engaged with the stop.
Figure 3:
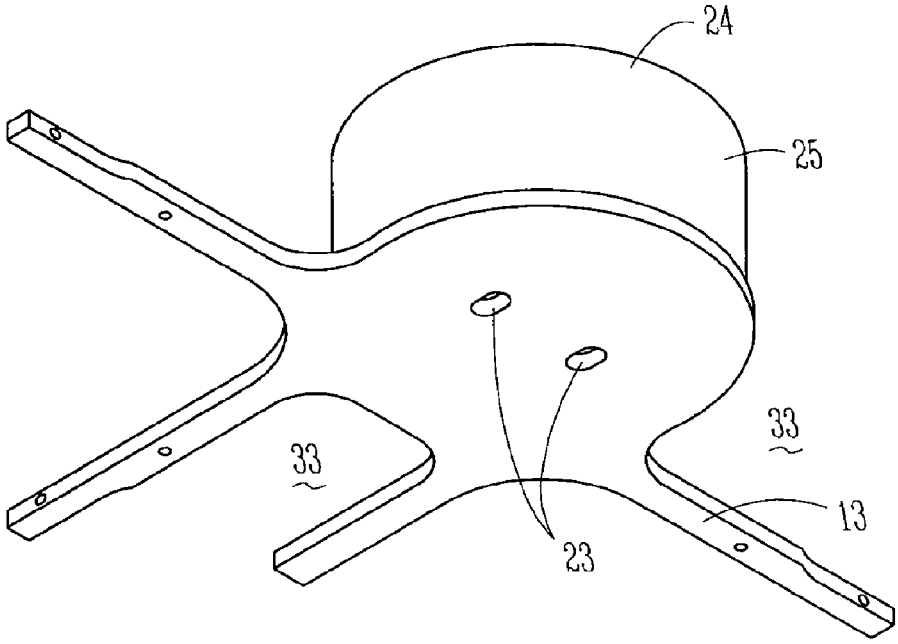
FIG. 3 is a perspective view of an example base and stop that may be used in the projectile shown in FIGS. 1 and 2.

FIGS. 1-2 illustrate a portion of an example projectile 10. The projectile 10 includes a frame 12 and a first gimbal 16 that is rotatably supported by the frame 12. The projectile 10 further includes a second gimbal 18 that is rotatably supported by the first gimbal 16. A sensor 20 is supported by the second gimbal 18 such that an adjustment mechanism 22 is able to maneuver the first and second gimbals 16, 18 to adjust the position of the sensor 20.

Figure 4:
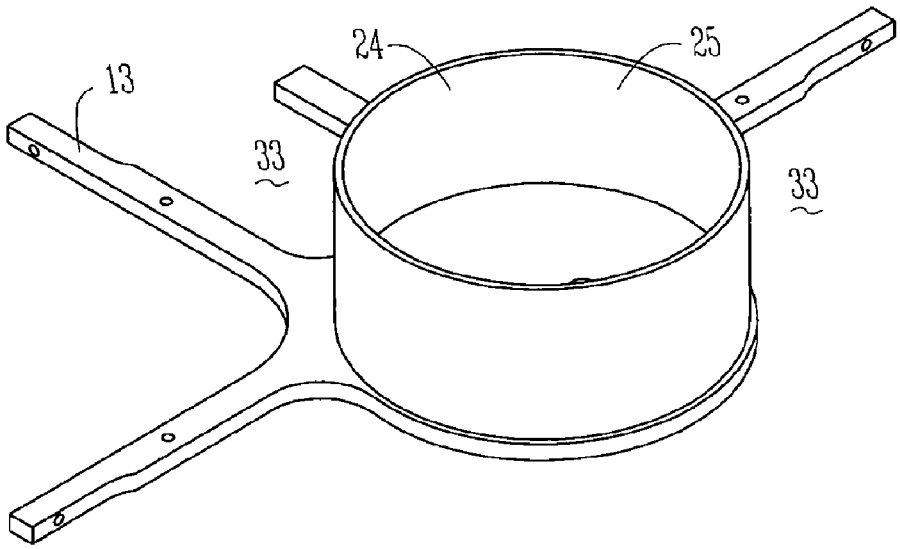
FIG. 4 is another perspective view of the example base and stop that may be used in the projectile shown in FIGS. 1 and 2.
Figure 5:
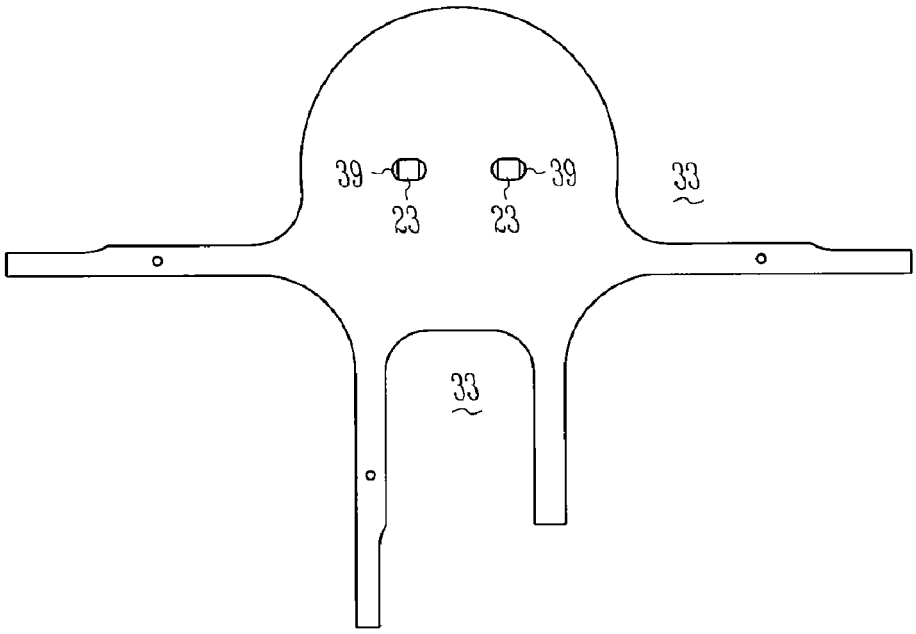
FIG. 5 is a bottom view of the example base and stop shown in FIGS. 3 and 4.
Figure 6:
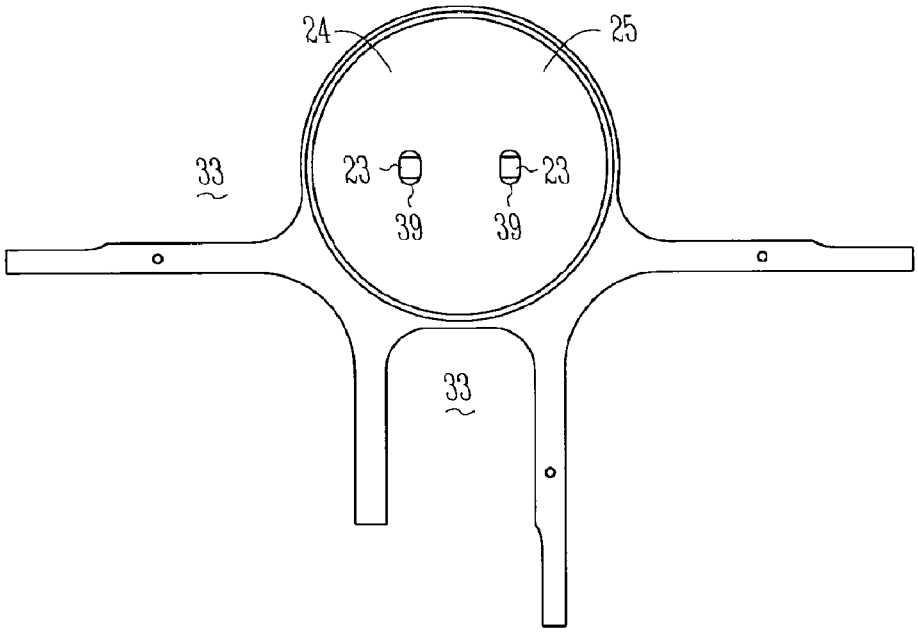
FIG. 6 is a top view of the example base and stop shown in FIGS. 3 and 4.
Figure 7:
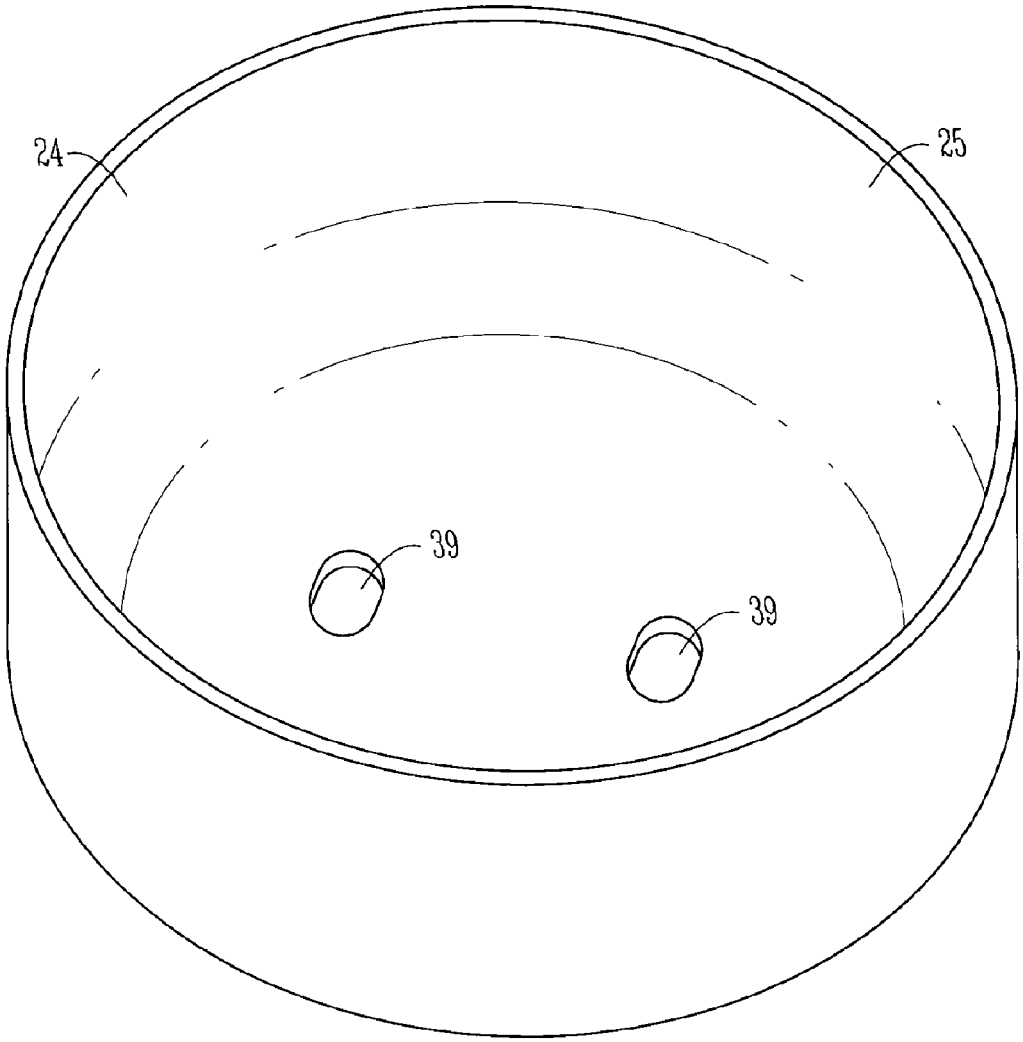
FIG. 7 is a perspective view of the example stop shown in FIGS. 1-6.

The projectile 10 further includes a stop 24 that is attached to the frame 12. In the illustrated example embodiment, the stop 24 is a cup 25 (shown most clearly in FIGS. 4 and 7) that surrounds a bottom portion 26 of the sensor 20 (see FIGS. 1 and 2). The cup 25 provides a barrier to prevent the adjustment mechanism 22 from maneuvering the sensor 20 outside a designated area. The size, shape and alignment of the stop 24 will depend in part on the type of adjustment mechanism 22 and sensor 20 that are utilized on the projectile 10 as well as the application where the projectile 10 is to be used. In some embodiments, the cup 25 may be formed of a vibration and/or shock dampening material to reduce impact load on the sensor 20.

Figure 8:
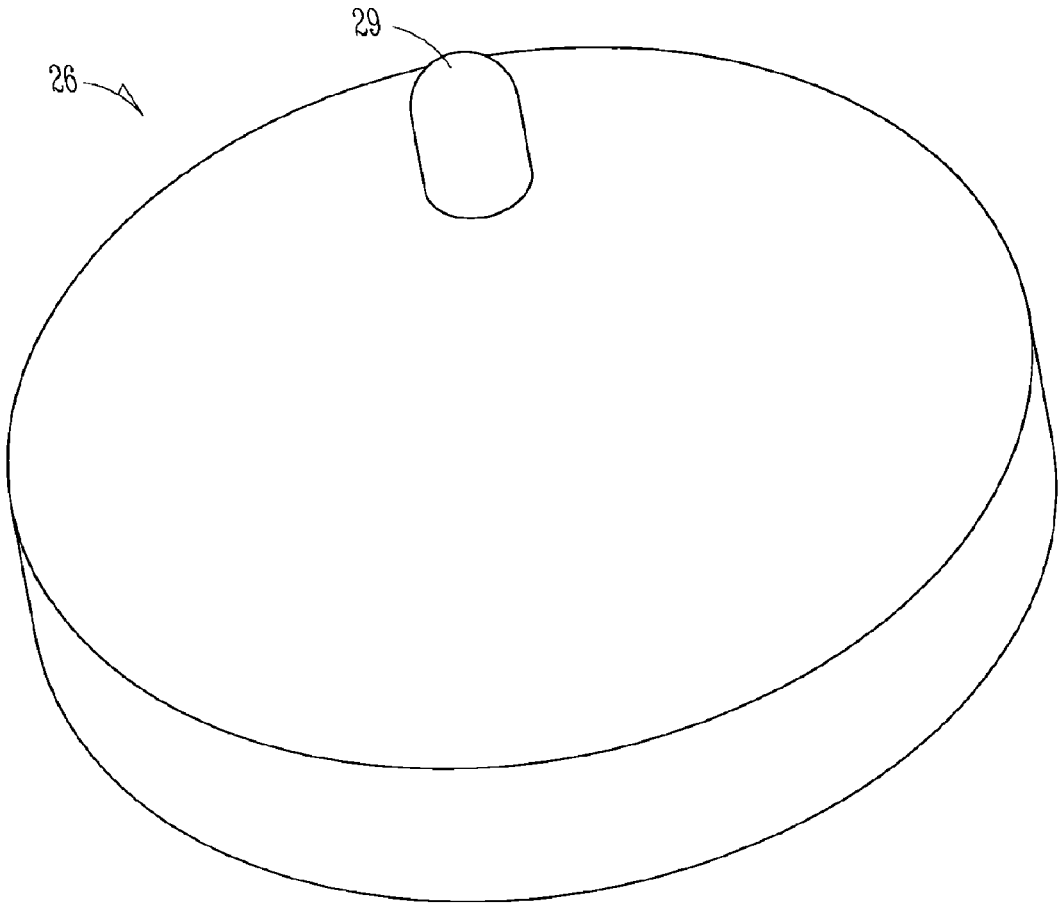
FIG. 8 is a perspective view of the example bottom portion of the sensor shown in FIGS. 1-2.

It should be noted that the bottom portion 26 of the sensor 20 may be integral with the sensor 20 or added to the sensor 20 to work in conjunction with the stop 24. FIG. 8 shows an example bottom portion 26 that may be surrounded by the cup 25. The bottom portion 26 may include a projection 29 that is adapted to engage the cup 25 to limit movement of the sensor 20 and/or the first and second gimbals 18 under certain circumstances.

In some embodiments, the bottom portion 26 of the sensor 20 may also be formed of a vibration and/or shock dampening material to reduce impact load on the sensor 20. In addition, the bottom portion 26 of the sensor 20 may include some form of counter-weight to facilitate maneuvering and balancing the sensor 20 during operation of the projectile 10.

In some embodiments, the sensor 20 is a camera 21. The cup 25 allows the camera 21 a full field of view during operation of the projectile 10. In addition, the size and shape of the cup 25 allows the sight of the camera 20 to be corrected (i.e., adjusted). It should be noted that embodiments are contemplated where the sensor 20 includes other types of active and/or passive sensors.

Embodiments are also contemplated where the frame 12 includes a base 13 below the sensor 20 such that the stop 24 is mounted on the base 13. In some embodiments, the base 13 may include some type of electromagnetic interference shielding 27 (see FIGS. 1 and 2) to help protect any electronics that are contained with the projectile 10.

The cup 25 may be secured to the base 13 with fasteners that extend through openings 23 in the base 13 and openings 39 in the cup 25. In some embodiments, the openings 23 in the base 13 and/or the openings 39 in the cup 25 may be slotted to permit the cup 25 to be readily adjusted so that it is easier to align the cup 25 relative to the sight of the sensor 20. It should be noted that in other embodiments, the cup 25 may be secured to the base 13 (or other part of frame 12) in any manner that promotes fabrication of the projectile 10.

As shown most clearly in FIGS. 3-6, the base 13 may include openings 33 (or areas void of material) such that sections of the adjustment mechanism 22 extend through the openings 33. The size, shape and alignment of the base 13 and openings 33 will depend in part on the size and type of adjustment mechanism 22 that is utilized on the projectile 10 as well as the application where the projectile 10 is to be used.

In some embodiments, the adjustment mechanism 22 includes a first actuator 23A that is attached to the frame 12 and a second actuator 23B that is attached to the frame 12. The first actuator 23A maneuvers the first gimbal 16 to adjust the position of the sensor 20 and the second actuator 23B maneuvers the second gimbal 18 to adjust the position of the sensor 20.

In the illustrated example embodiments, the first actuator 23A includes a drive 30A and a push rod 32A and the second actuator 23B includes a drive 30B and a push rod 32B. The position, size and shape of the cup 25 allow the cup 25 to avoid the pushrods 32A, 32B during operation of the projectile 10.

As shown most clearly in FIGS. 1 and 2, the second gimbal 18 may form part of a body of the sensor 20. As an example, the sensor 20 may be fabricated with the second gimbal 18 incorporated right into the sensor 20. In addition, the second gimbal 18 may also be fabricated for ready connection to the first gimbal 16. Note that the attachment of the second gimbal 18 to the first gimbal 16 is not visible in the orientation of the particular schematic section view shown in FIGS. 1 and 2.

Another example embodiment relates to a gimbal stop that includes a movable sensor 20 which is maneuvered by using an adjustment mechanism 22 to position a first gimbal 16 that is supported by a frame 12 and to position a second gimbal 18 that is supported by the first gimbal 16. The gimbal stop includes a base 13 supported the frame 12 and a cup 25 mounted to the base 13. The cup 25 surrounds a bottom portion 26 of the sensor 20 to provide a barrier to prevent the adjustment mechanism 22 from maneuvering the sensor 20 outside a designated area. The gimbal stop may be utilized in a projectile or any system that includes a movable sensor which requires a mechanical stop to limit movement of the sensor.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. A projectile comprising:

a frame;

a first gimbal rotatably supported by the frame;

a second gimbal rotatably supported by the first gimbal;

a sensor supported by the second gimbal;

an adjustment mechanism that maneuvers the first and second gimbals to adjust the position of the sensor; and a stop attached to the frame, the stop surrounding a bottom portion of the sensor such that when the sensor engages the stop, the stop prevents the bottom portion of the sensor from maneuvering outside a designated area.

2. The projectile of claim 1, wherein the sensor is a camera.

3. The projectile of claim 1, wherein the stop is a cup.

4. The projectile of claim 1, wherein the frame includes a base below the sensor such that the stop is mounted on the base.

5. The projectile of claim 4, wherein the base includes openings such that sections of the adjustment mechanism extend through the openings.

6. The projectile of claim 4, wherein the base includes electromagnetic interference shielding.

7. The projectile of claim 4, wherein the stop is secured to the base with fasteners.

8. The projectile of claim 1, wherein the adjustment mechanism includes:

a first actuator attached to the frame, the first actuator maneuvering the first gimbal to adjust the position of the sensor; and a second actuator attached to the frame, the second actuator maneuvering the second gimbal to adjust the position of the sensor.

9. The projectile of claim 8, wherein the first actuator includes a drive and a push rod and the second actuator includes a drive and a push rod.

10. The projectile of claim 1, wherein the projectile is a missile.

* * * * *